United States Patent [19]

Roether

[11] Patent Number: 4,710,245

[45] Date of Patent: Dec. 1, 1987

[54] METHOD OF MAKING TUBULAR UNITS FOR THE OIL AND GAS INDUSTRY

[75] Inventor: Kurt Roether, Duesseldorf, Fed. Rep. of Germany

[73] Assignee: Mannesmann AG, Duesseldorf, Fed. Rep. of Germany

[21] Appl. No.: 806,764

[22] Filed: Dec. 9, 1985

[30] Foreign Application Priority Data

Dec. 10, 1984 [DE] Fed. Rep. of Germany ..... 3445371

[51] Int. Cl.[4] ..... C21D 9/08

[52] U.S. Cl. ..... 148/12.4; 148/127

[58] Field of Search ..... 148/127, 12.4

[56] References Cited

U.S. PATENT DOCUMENTS 4,608,101 8/1986 Umemoto ..... 148/127

*Primary Examiner*—R. Dean

*Attorney, Agent, or Firm*—Ralf H. Siegemund

[57] ABSTRACT

A method of making tubing and pipes for conduction in the oil and gas industry or for use as drillpipes, wherein such tubing is connected at both ends with connector sleeves by means of welding, the welding seam being deburred thereafter. The steel used for the tubing, pipes or drill pipes as well as for the connector sleeves has the following composition, all percentages by weight, between 0.2 and 0.6% carbon, between 0.5 and 1.8% manganese, between 0.5 and 3.5% combined chromium and molybdenum, not more than 0.2% phosphorus and not more than 0.005% sulphur. The combined unit of tubing and two welded on connectors is heated to a temperature which is at least 50 but not more than 200 degrees Centigrade above AC3; quenched from this temperature down to a temperature of at least 200 degrees Centigrade below AR1, tempered at a temperature below AC1, and cooled in non-moving air, to obtain the following properties: yield strength between 515 to 760 N/square mm, tensile strength at least 660 N/square mm, elongation at least 15.5%, hardness not more than 26 HRC, impact notch ductility at room temperature in accordance with ISOV of at least 60 Joules, long duration strength tested for more than 720 hours in accordance with NACE-TM-01-77 in a hydrogen sulphide saturated test solution at a load of not less than 80% of said minimum yield strength.

4 Claims, 1 Drawing Figure

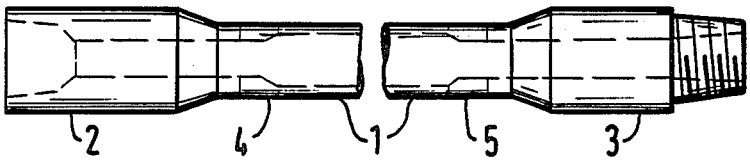
2
4
1
5
3

METHOD OF MAKING TUBULAR UNITS FOR THE OIL AND GAS INDUSTRY

BACKGROUND OF THE INVENTION

The present invention relates to the manufacture of tubing to be used in the oil and gas industry either for purposes of immediate and direct conduction of oil and gas or for purposes of use as drill pipes whereby in either case tubes or pipes possibly with thin walls are used to be welded to connecting sleeves to establish a tubular element with threaded ends for use as conduit element e.g. in a pipeline or as element in a string of drill pipes. The tubing or pipes leave preferably relatively thick e.g. upset end portions for connection to connecting sleeves.

Tubing for the oil and gas industry as well as drill pipes to be interconnected are used generally in oil drilling and exploration in great depth or to conduct the oil or gas out of and away from the site. In the latter case at least some of the tubing is used above ground. These tubes or pipes experience a high mechanical load primarily on account of the internal pressure and longitudinal forces. On the other hand drill pipes experience an additional load on account of the weight of the drill head, the weight of the drill pipe itself and the torque resulting from drilling as well as from any bending. Therefore one will almost exclusively use high grade steel tubing and pipes for these purposes which after tempering are connected to coupling or connecting sleeves. Usually these connecting sleeves are of the flange variety or they are particularly thick walled, short tubes with a suitable threading so that a unit composed of a pipe and/or tube proper with connecting sleeve attached to either end can now be interconnected to form a large string of tubing or drill pipes. In the past these connecting sleeves have usually been first threaded onto the respective pipe ends or tube ends and thereafter welded thereto. More recently it has become customary to directly connect the connecting sleeves to the tube or pipe by means of welding and subsequently the welding seam is deburred and stress relieving annealled.

Tubes and drill pipes made in the aforementioned manner satisfy practical requirements as far as particular physical properties are conerned such as yield strength, yield point elongation etc. But in the presence of moist acid gas the load in that sense must not even come close to the yield strength. Particularly the transition zones between the welding seam and the basic material are highly prone to a stress corrosion cracking if the tubing is made in the conventional manner. The resistance against stress corrosion is tested for example in a saturated hydrogen sulfide test solution in accordance with NACE standards TM-01-77.

DESCRIPTION OF THE INVENTION

It is an object of the present invention to increase the capability of tubing and drill pipes made in the aforementioned manner to withstand corrosion mechanical loads and to match these aspects with the requisite physical properties. It is therefore a particular object of the present invention to provide a new and improved method of making tubing and pipes for conduction in the oil and gas industry or for use as drillpipes wherein such tubing is welded at both ends to connector sleeves and the welding seam having been deburred and the unit so produced is being heat treated (tempered) and subjected to cutting.

In accordance with the preferred embodiment of the present invention it is suggested that tubing or pipes as well as connecting sleeves to be welded thereto are made of a steel which includes (all percentages by weight) from 0.2 to 0.6% carbon, from 0.5 to 1.8% manganese, from 0.5 to 3.5% chromium and molybdenum combined, not more than 0.02% phosphorus and not more than 0.005% sulphur; the remainder being iron. Tubes or pipes and connector sleeves are welded together as is known per se and deburred and heat treated, i.e. quenched and tempered subsequently to obtain the following properties: yield strength from 515 to 760 Newtons per square millimeters, tensile strength at least 660 Newtons per square millimeters, elongation (at yield point) at least 15.5%, hardness maximum 26 HRC and impact notch ductility at room temperature of at least 60 Joules for ISO V, duration of the yield strength should exceed 720 hours in accordance with NACE TM-01-77 for a hydrogen sulfide saturated test solution and for load of at least 80% of the minimum yield strength.

The resulting string of pipelines or tubing will be particularly suitable for conducting on the surface hydrogen sulfide containing oil or natural gas; drill pipes made in the same manner are to serve primarily for drilling wells and holes under ambient conditions exhibiting moist acid gas and whereby the mechanical loads on the drill pipe is very high. It is not important for the invention whether or not the tubing which constitutes so to speak the raw product on which the invention is practised, have been cooled in aiar following the hot rolling or whether a normalizing annealling step is interposed. Tempering of the tubing is therefore likewise unnecessary. However in order to provide a smooth transition between tube and connecting sleeve the wall of the tube or pipe should be upset in a suitable machine (e.g. a forging die) in axial direction but involving only the end of the tubing or pipes. A thicker wall that is instrumental for providing a broader area for welding. Generally speaking connecting sleeves are flange elements or short and thick pieces of pipe. In the latter case one side is cut down to the thickness of the wall or the tubing to which the sleeve is to be connected; also the connecting sleeves have been prepared for threading. Connecting sleeves made as per the invention likewise do not have to be heat treated prior to welding. Other connecting sleeves are known with a prepared outer or inner threading and they are connected in pairs with the ends of the tubing by means of press welding and the burr subsequently removed. All these types of connecting sleeves in terms of configuration can be used within the purview of the invention.

Tubing, pipes and connectors are made of a steel composition which is not resitive against ablative corrosion. Drill pipes made of this steel however can be protected by adding inhibitors, as is customary, to the drill fluid so that ablative corrosion is no longer a factor. On the other hand the steel composition is chosen so that the wall thickness in case of water or oil quenching, even for the largest thickness value for the tubing, the pipes as well as the connector sleeves still make sure that hardening and strengthening extend through the entire depth of the wall so that the entire wall has fairly uniform hardness and therefore uniform strength properties.

Tubing and pipes to be used as oil conduit or units to be used in drill pipes will be hardened as a whole. As far as possible in terms of dimensions, dipping is to be used for quenching. Thereafter these parts are tempered again and the termal treatment ends by a regular cooling in air. In particular the tempering and thermal treatment is to be carried out as follows. The tubing pipes are heated to a temperature which is at least 50 degrees Centigrade but not more than 200 degrees C. above the so called AC3 level following which quenching occurs down to a temperature being at least 200 degrees centigrade below AR1 following which reheating (tempering) occurs to a temperature that remains below AC1, and thereafter the tubing, pipes or connectors are cooled in air. This way the parts have a corrosion resistance over the entire length and particularly in the welding zone including those parts of the basic material which will be affected temperaturewise by the welding process. In comparison to a smooth tube they have a uniform internal microstructure and texture and therefore corresponding to similar mechanical properties. After the thermal treatment as described the requisite mechanical work is carried out as is conventional such as cutting the thread as well as cutting sealing and/or abutment shoulders.

A preferred method of practicing the invention uses a steel with 0.4 to 0.55% carbon; 0.8 to 1.8% manganese; 0.5 to 3.5% chromium and molybdenum combined; not more than 0.02% phosphorus and not more than 0.055% sulphur, the remainder being iron. After welding, deburring and tempering the resulting steel had the following specific properties: yield strength of 655 to 760 N/square mm; tensile strength of 720 N/square mm; the other properties as listed earlier.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

The FIGURE illustrates a unit or product being comprised of one tube and two connectors.

As to details the FIGURE illustrates a tube or pipe 1 of suitable length having its ends connected by welding to connector sleeves 2 and 3. The final product will not show the welding seams but they are in the areas 4 and 5. The connector 2 has its free and provided with an internal threading while the connector 3 has a conical external threading.

A particular example for practicing the invention is useful for drill pipes and uses the following composition, all percentages by weight, for the steel 0.45 carbon, 0.25 silicon, 0.9 manganese, 1.26 chromium, 0.36 molybdenum, 0.012 phosphorus and 0.002 sulphur with the remainder being iron.

Initial hollows are made from continuously cast ingots and through oblique rolling to obtain a seamless hollow which is followed by stretch rolling, by means of a cylindrical rod in a continuous mill. The hollow is stretch reduced thereafter to obtain final dimensions of 114.3 mm diameter at 9.19 mm wall thickness. The tubing thus made is cooled in non-moving air. Thereafter end portions of about 300 mm length are reheated for upsetting that portion to obtain a wall thickness of about 22 mm and an outer diameter of about 131 mm. Thereafter the thus upset tubing is again cooled in non-moving air. The resulting tubing is of the type identified by numeral 1 in the FIGURE.

Analogously one can make thick walled pipes in the same manner, such pipes to have an outer diameter of 162 mm, a wall thickness of 36 mm, but then only are cut into short sections of about 370 mm length. These sections are to be used as connector sleeves and in pairs with a rough thread grinding on the outside in one or the other, to obtain the sleeves 2 and 3 on the inside.

Tube or pipe 1 has been thereafter connected to these two connectors 2 and 3 by means of friction welding and the gear has been deburred as for example shown in German printed Pat. No. 31 33 181. The FIGURE therefore can be interpreted as a drill pipe unit or element in its full length. In that configuration it is quench hardened and reheated under utilization of structure shown in German Pat. No. 15 83 993. Quenching is carried out from a temperature of 890 degrees C. using oil as quench medium and the quenching is to last about two minutes. The drill pipe unit will thereafter be placed on a suitable grate and thereby exposed to non-moving air. The tempering temperature chosen was 690 degrees. After cooling in air it may be necessary to size the unit as to straightness.

Such a unit or element has the following physical properties: yield strength 694 N/square mm, tensile strength 813 N/square mm, elongation 26%, hardness 25.3 HRC, impact notch ductility at 20 degrees Centigrade ISO V: 80 Joules. A sample chosen from a plurality of units made in this fashion was found to withstand a strength duration tests in accordance with NACETM0177 with a load corresponding to 80% of the minimum yield strength (655 N/square mm). The test exceeded the prescribed 720 hours of exposure. In any event after the heat treatment as described the unit underwent to the requisite mechanical working steps which are conventional.

The invention is not limited to the embodiments described above but all changes and modifications thereof, not constituting departures from the spirit and scope of the invention, are intended to be included.

I claim:

1. A method of making tubing and pipes for conduction in the oil and gas industry or for use as drillpipes, wherein such tubing is connected at both ends with connector sleeves by means of welding, the welding seam being deburred thereafter and the unit so produced being heat treated and subjected to cutting, the improvement comprising:

providing tubing, pipes or drill pipes as well as connector sleeves made of steel consisting essentially of the following composition, all percentages by weight, between 0.2 and 0.6% carbon, between 0.5 and 1.8% manganese, between 0.5 and 3.5% combined chromium and molybdenum, not more than 0.2% phosphorus and not more than 0.005% sulphur;

heat treating by quenching and tempering the combined unit of tubing and two welded on connectors to obtain the following properties: yield strength between 515 to 760 N/square mm, tensile strength at least 660 N/square mm, elongation at least 15.5%, hardness not more than 26 HRC, impact notch ductility at room temperature in accordance with ISOV of at least 60 Joules, long duration strength tested for more than 720 hours in accordance with NACE-TM-01-77 in a hydrogen sulfide saturated test solution at a load of not less than 80% of said minimum yield strength.

2. Method as in claim 1, said heat treatment comprising heating the unit to a temperature which is at least 50 but not more than 200 degrees Centigrade above AC3; quenching from this temperature down to a temperature of at least 200 degrees Centigrade below AR1 and reheating (tempering) to a temperature below AC1 and cooling in non-moving air.

3. Method as in claim 2 using a steel with 0.4 to 0.55% carbon, 0.8 to 1.8 4% manganese, 0.5 to 3.5% chromium and molybdenum combined, not more than 0.02% phosphorus and not more than 0.0025% sulphur to obtain yield strength from 655 to 760 N/square mm and a tensile strength of about 720 N/square mm.

4. Method as in claim 2 wherein the temperature of tempering is above the temperature of stress relief annealing.

* * * * *